US005086528A

United States Patent [19]

Miller

[11] Patent Number: 5,086,528

[45] Date of Patent: Feb. 11, 1992

[54] WATER MATTRESS AND METHOD FOR MAKING SAME

[76] Inventor: Craig S. Miller, 6092 Ohio St., Yorba Linda, Calif. 92686

[21] Appl. No.: 584,765

[22] Filed: Sep. 18, 1990

[51] Int. Cl.[5] ..... A47C 27/08

[52] U.S. Cl. ..... 5/451; 5/450; 156/308.4

[58] Field of Search ..... 5/450, 451, 422, 449, 5/452; 156/308.4

[56] References Cited

U.S. PATENT DOCUMENTS

| | | | |
|---|---|---|---|
| 4,186,455 | 2/1980 | Fox, Jr. et al. | 5/451 |
| 4,187,566 | 2/1980 | Peterson | 5/451 |
| 4,245,363 | 1/1981 | Callaway | 5/451 |
| 4,523,343 | 6/1985 | Fraige | 5/451 |
| 4,577,357 | 3/1986 | Hall et al. | 5/451 |
| 4,583,254 | 4/1986 | Johenning | 5/451 |
| 4,656,681 | 4/1987 | Alexander | 5/451 |
| 4,672,700 | 6/1987 | Poncy | 5/450 |
| 4,737,998 | 4/1988 | Johnson, Jr. | 5/422 |
| 4,754,514 | 7/1988 | Limb | 5/502 |
| 4,864,670 | 9/1989 | Woll et al. | 5/450 |

*Primary Examiner*—Alexander Grosz
*Attorney, Agent, or Firm*—Richard L. Myers

[57] ABSTRACT

A watermattress having a first sheet and a second sheet forming a container for receiving water includes a third sheet for dividing the container into a bladder for receiving water and a cavity. A sheet of foam including portions which define a plurality of holes is disposed in the cavity where means is provided for joining the second sheet and the third sheet through the holes in the foam sheet for maintaining the foam sheet in its generally planar configuration within the container.

7 Claims, 3 Drawing Sheets

WATER MATTRESS AND METHOD FOR MAKING SAME

BACKGROUND OF THE INVENTION

1. Field of the Invention

This concept relates generally to waterbed mattresses and more specifically to water mattresses including dry foam or fiber.

2. Discussion of the Prior Art

Water mattresses of the past have all included a water cavity or bladder formed from water impervious materials. These materials have typically included multiple sheets of polyvinylchloride which have been heat sealed together to form the bladder cavity.

In some cases sheet foam has been disposed in the water cavity to provide the water mattress with additional resiliency. This sheet of foam has been corrugated or otherwise configured to provide the upper surface of the mattress with an attractive appearance. Since the foam has tended to float on the water within the bladder, it has also been relied on to elevate the top sheet and provide a billowed appearance.

Although the foam sheets have had optimum resiliency characteristics in a dry state, such as in air, they nevertheless have improved the general resiliency of the mattress even when disposed in contact with the water in the bladder cavity.

Taking advantage of the optimum resiliency characteristics, dry foam has been disposed outside of the bladder cavity and enclosed in overlying relationship with the bladder typically in a fabric envelope. This configuration has increased the complexity of the manufacturing process since the foam and fabric envelope have had to be dealt with separately from the bladder manufacturing process. This dry foam has not been fixed to the materials forming the bladder cavity, so that it has tended to gather forming an uneven sleeping surface.

SUMMARY OF THE INVENTION

These problems associated with the prior art have been overcome in accordance with the method and apparatus associated with the present invention. A water mattress is provided with a bladder which is formed from vinyl sheet material configured to form a bladder cavity for receiving the water. Dry foam is disposed exteriorly of the cavity and is isolated from the water in the cavity. An additional sheet of vinyl material is sealed to the bladder around the periphery of the mattress to enclose the foam in an air cavity. Holes are provided in the additional sheet to introduce air into the foam cavity. If the additional sheet is formed of a vinyl material, it can be heat sealed around its periphery to the vinyl sheets forming the bladder.

With this configuration, the foam associated with this mattress remains in its dry state of optimum resiliency. This not only enhances the comfort of the water mattress but also the resultant appearance of the product.

In one aspect of the invention, first means forms a first cavity which is adapted to receive water. Second means forms a second cavity which is disposed in a generally overlying relationship with the first means. A resilient material, such as foam, is disposed in the second cavity in isolated relationship with any water in the first cavity and a heat seal is provided for maintaining the first means in a generally fixed relationship with the second means. In this case, the first means includes a particular wall which is common to both the first cavity and the second cavity.

In another aspect of the invention the water mattress includes a first sheet of heat sealable material forming a bottom of the mattress, a second sheet of heat sealable material forming a top of the mattress, and third sheet of heat sealable material disposed between the first and second sheets. The third sheet forms with the first sheet a bladder for receiving the water and forms with the second sheet a particular cavity which is isolated from the water in the bladder by the third sheet. A resilient material, such as foam, is disposed within the particular cavity in isolated relationship with any water in the bladder so that the foam retains its optimum resiliency characteristics. In this case, the first sheet, second sheet and third sheet can be joined in a common heat seal extending around the periphery of the mattress. Further seals can be provided to join the second sheet and third sheet through holes in the foam. This provides the foam with a generally fixed relationship with the bladder.

In a preferred method for making the mattress, a sheet of resilient material such as foam is provided with portions defining a hole. A heat sealer is provided with first and second planar die members and at least one conductor extending a first distance therebetween. A compressible nonconductive pillar is also provided and extends a second distance greater than the first distance between the first and second die members. The foam is sandwiched between two sheets of vinyl and supported on the compressible pillar with the foam hole disposed over the conductor. This sandwich is pressed against the compressive force of the pillar until the two dies are brought into heat sealing relationship with the two sheets extending through the foam hole. This process greatly facilitates the manufacture of the water mattress including dry foam.

These other features and advantages associated with the present invention will be more apparent with a discussion of preferred embodiments of the concept and reference to the associated drawings.

DESCRIPTION OF PREFERRED EMBODIMENTS

Figure 1:
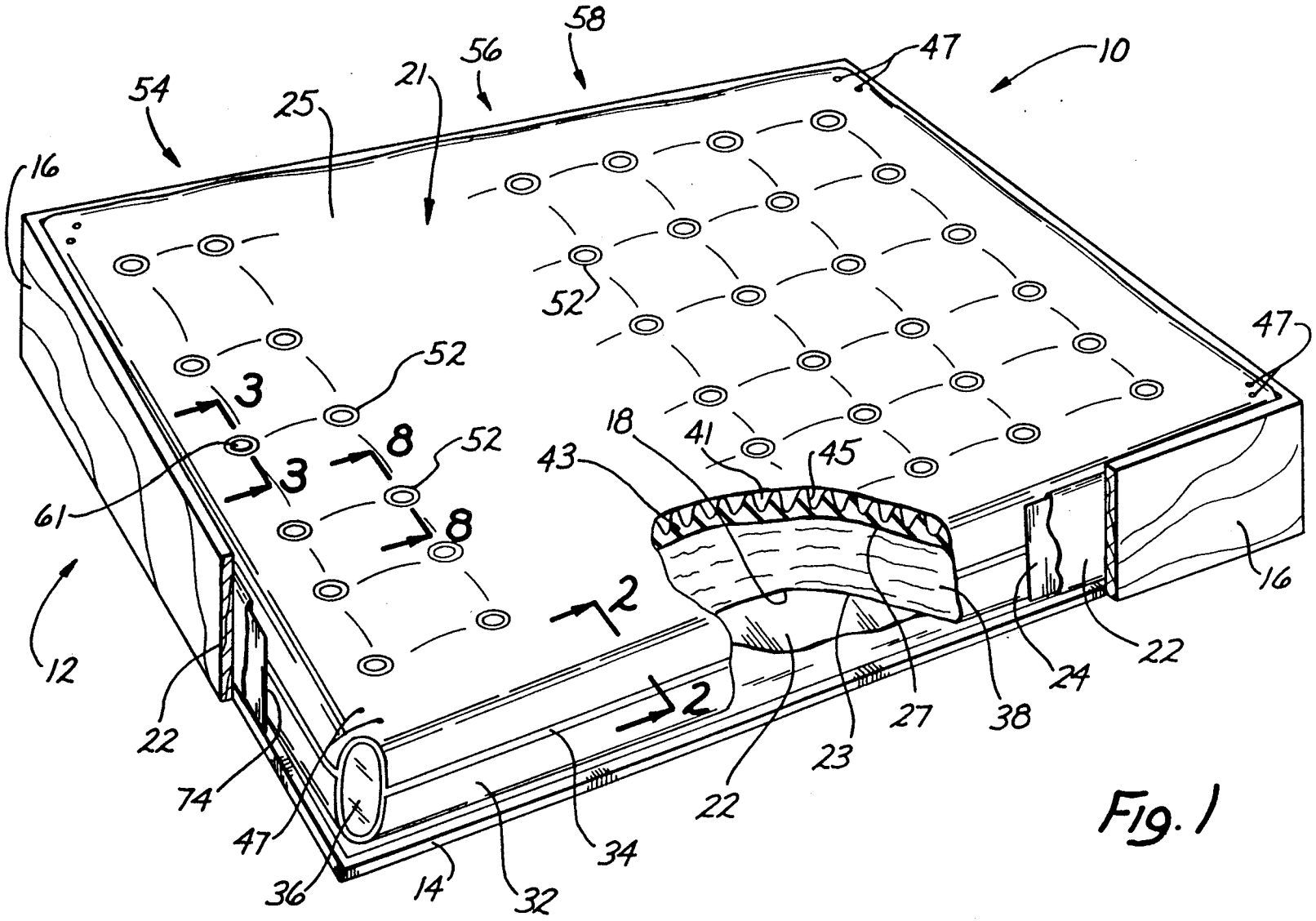
FIG. 1 is a perspective view of one embodiment of the water mattress associated with the present invention.
Figure 2:
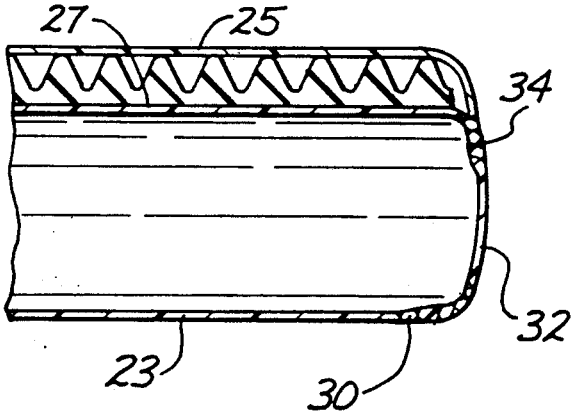
FIG. 2 is a partial cross-sectional view taken along lines 2—2 of FIG. 1.

A water mattress is illustrated in FIG. 1 and designated generally by the reference numeral 10. The mattress 10 is disposed in a container or frame 12 including a base board 14 and a plurality of side boards 16 form the frame 12 which is adapted to receive, support and contain the mattress 10. A vinyl liner 22 including upstanding foam side walls 24 is typically disposed between the mattress 10 and the frame 12. The frame 12 can be supported on a floor or various other structures (not shown) which are well known in the art.

The mattress 10 has a generally planar configuration with two major surfaces, a bottom surface 18 and a top surface 21. The bottom surface 18 is typically disposed in contact with the base board 14 while the top surface 21 provides a sitting or sleeping surface for the user.

In the illustrated embodiment the mattress is formed from a bottom sheet 23, which provides the bottom surface 18, and a top sheet 25, which provides the top surface 21. A third sheet 27 is disposed in generally parallel relationship with and between the bottom sheet 23 and top sheet 25.

The three sheets 23, 25 and 27 can be formed from 20 mill polyvinylchloride material. They each extend across the entire area of the mattress 10 and are joined at their perimeter edges in a variety of configurations. For example, in the illustrated embodiment, a L-corner construction is shown where the bottom sheet 23 is joined at a perimeter heat seal 30 to one of the longitudinal edges of a gusset panel 32 which forms the side of the mattress 10. The top sheet 25 and third sheet 27 are joined at their perimeter edges to the other longitudinal edge of the gusset panel 32 by a heat seal 34. A corner patch 36 is provided to seal each corner of the mattress 10 in the manner described in applicants U.S. Pat. No. 4,251,308. This design is merely representative of several of the water mattresses of the prior art which includes a bottom sheet and a top sheet such as the sheets 23 and 25.

Of particular interest to the present invention is the third sheet 27 which extends across the mattress 10, and is joined, for example at the heat seal 34 to at least one of the top sheet 25, bottom sheet 23 or gusset panel 32. It is this sheet 27 which divides the mattress 10 into a water cavity 38 and an air cavity 41. It is particularly important that the air cavity 41 be isolated from the water cavity 38, so the seam 34 must be impervious to any water disposed in the cavity 38.

The cavity 41 is particularly adapted to receive a sheet of resilient material such as foam 43 and to maintain that sheet in a relatively dry state. Foam is well known to have its optimum resiliency characteristics in a dry state so disposition of the foam 43 in the air cavity 41 greatly increases the comfort of the mattress 10. The foam sheet 43, which can be formed from either open cell foam or closed cell foam, is typically provided with corrugations 45 or an egg crate configuration in order to enhance the appearance of the mattress 10. The foam sheet 43 can be formed from either open cell or closed cell foam.

The sheet of resilient material can include any composition or form with characteristics for compressing in response to a person lying on the mattress 10 and resilient characteristics tending to return the sheet to its uncompressed state. A material which has enhanced resiliency characteristics in a dry state will benefit most from this invention. In a preferred embodiment, the resilient material includes polyester fibers. Such fibers, which can be interwoven to form a sheet, have optimum resiliency characteristics in a dry state.

In accordance with one aspect of the invention, the bottom sheet 23 and top sheet 25 form a bladder which is adapted to receive water. The third sheet 27 is disposed intermediate the sheets 23 and 25 to separate the bladder into the two cavities 38 and 41. Thus the sheet 27 provides means for isolating the cavity 41 from the cavity 38.

In still another aspect of the invention, the sheets 23 and 27 provide means for forming the cavity 38, and the top sheet 25 provides means for forming the overlying cavity 41. Thus the sheet 27 provides a wall which is common to both the cavity 38 and the cavity 41.

When a person sits or lies on the mattress 10, the weight of the person tends to reduce the volume of the air cavity 41. In order to maintain the floatation effect of the mattress 10, it may be desirable to provide holes 47 or other relief mechanism to vent the cavity 41. Then when the person sits or lies on the mattress 10 and the volume of the cavity 41 is decreased, the air within the cavity 41 can exist the mattress 10 through the holes 47. When the weight of the person is removed from the mattress 10, the foam 43 will expand to its original configuration enlarging the volume of the air cavity 41. This will tend to create a vacuum drawing air through the holes 47 into the cavity 41. Bilateral valving mechanisms (not shown) can be provided to control the flow of air through the holes 47. In a preferred embodiment however, the holes 47 remain unrestricted to facilitate contraction and expansion of the cavity 41.

Figure 8:
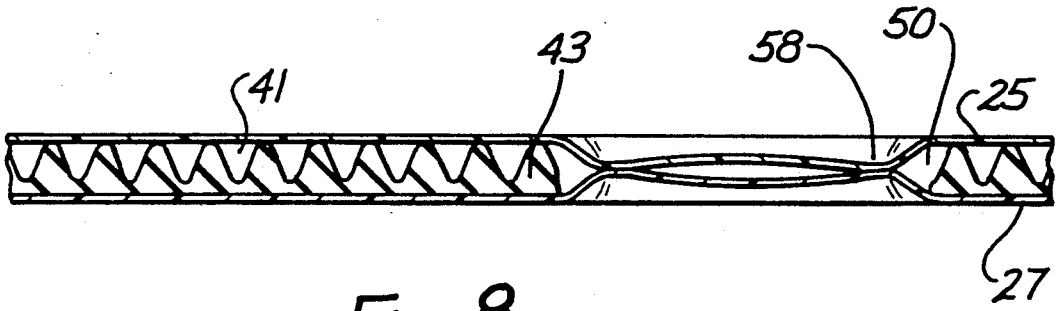
FIG. 8 is a side elevation view of a subassembly of the present invention illustrating dry foam and a heat seal formed through holes in the foam to maintain a generally planar configuration in an inflated state after the vent holes are open.

In a preferred embodiment, means is provided for retaining the foam 43 in its generally planar configuration in proximity to the upper surface 21 of the mattress 10. As illustrated in FIGS. 1 and 8, this retention means can be provided by joining the top sheet 25 and third sheet 27 through holes in the foam sheet 43. For example, with reference to FIG. 8, the foam sheet 43 is provided with a hole 50 and the sheets 25 and 27 are joined at a circular heat seal 52 through the hole 50. A multiplicity of these heat seals 52 can be provided in a pattern of rows and columns as illustrated in FIG. 1. Each of the seals is associated with a respective hole, such as the hole 50, in the foam sheet 43.

Additional support can be provided for a person lying on the mattress 10 if several adjacent rows of the seals 52 are eliminated in an area disposed to support the lumbar region of a user. Thus, in the illustrated embodiment, a plurality of the seals 52 are arranged in three consecutive rows 54, 56 and 58. However, the distance separating the adjacent rows 54 and 56 is greater than the distance separating the adjacent rows 56 and 58. Preferably this area of separation between the adjacent rows 54 and 56 is located in an area which would typically support the lumbar region of a person lying on the mattress 10. In a preferred embodiment, the distance separating the rows 54 and 56 is three times greater than the distance separating the rows 56 and 58. In other words, two of the rows otherwise present in a symmetrical alignment of rows and columns have been eliminated in this area of the mattress 10. Since the foam sheet 43 tends to compress in proximity to each of the seals 52, it follows that where the seals are eliminated, the foam 43 and hence the surface 21 has an elevated, uncompressed configuration that provides a greater support for the lumbar region of the user.

Figure 3:
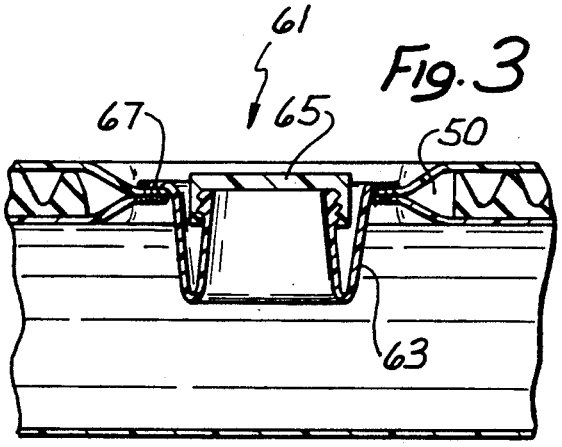
FIG. 3 is a partial cross-sectional view taken along lines 3—3 of FIG. 1.

In a process similar to that forming the seals 52, a fill valve 61 can be provided as illustrated in FIG. 3. The valve 61 typically includes flexible side walls 63 and a cap 65 which forms a removable seal with the walls 63. This valve 61 provides access to the water cavity 38 to facilitate filling and evacuation of the cavity 38 with water. In order to simplify this process, the valve is preferably oriented to extend through the top sheet 25.

Thus, in a preferred embodiment, one of the holes in the foam 43, such as the hole 50 is selected for accommodation of the fill valve 61. In this location, the top sheet 25 is joined to the sheet 27 through the hole 50, and a circular seal 67 includes both of the sheets as well as the side wall 63 of the valve 61.

Not only are the resiliency characteristics of the foam sheet 65 optimized in a dry state, but so are the insulative characteristics of the foam. With the foam sheet 43 filled with air instead of water, it has superior insulation qualities for inhibiting the loss of heat from the water cavity 38. It is well known in the art that the water in a water bed must be heated above room temperature in order to provide a suitable sleeping surface. Loss of this heat to a cooler room temperature requires that the water be continually heated in order to maintain its temperature.

This heat is loss primarily through the major surface which is exposed to room temperature, that is the upper surface of the mattress 10. When the dry foam sheet 43 is disposed between the water in the cavity 38 and the room temperature, the loss of heat is significantly decreased. Thus in accordance with the present invention, the foam sheet 33 provides a thermal barrier which significantly reduces heat lost from the mattress 10 and consequently heat which is required to maintain the water temperature. A 63% increase in the efficiency of heating the mattress 10 has been demonstrated with the presence of the dry foam sheet 43.

Another significant advantage which accrues to the present invention occurs when a person lies on the mattress 10. In the small area where the person is supported, the foam sheet 43 is compressed. In this compressed area, the insulative characteristics of the foam 43 are decreased and the transfer of heat from the water to the person is increased. This not only increases the comfort of the person lying on the bed, but it does so without disturbing the insulation qualities of the foam 43 and other areas of the mattress. Thus, when thermal transfer is desire the foam sheet 43 actually facilitates that transfer. However in the other areas where the insulative effects are particularly appreciated, the foam sheet 43 continues to provide a thermal barrier.

Figure 4:
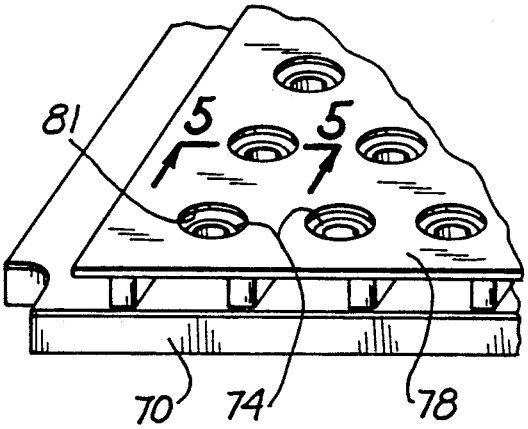
FIG. 4 is a perspective view of a heat seal die particularly useful in a preferred method of manufacturing the water mattress of the present invention.
Figure 5:
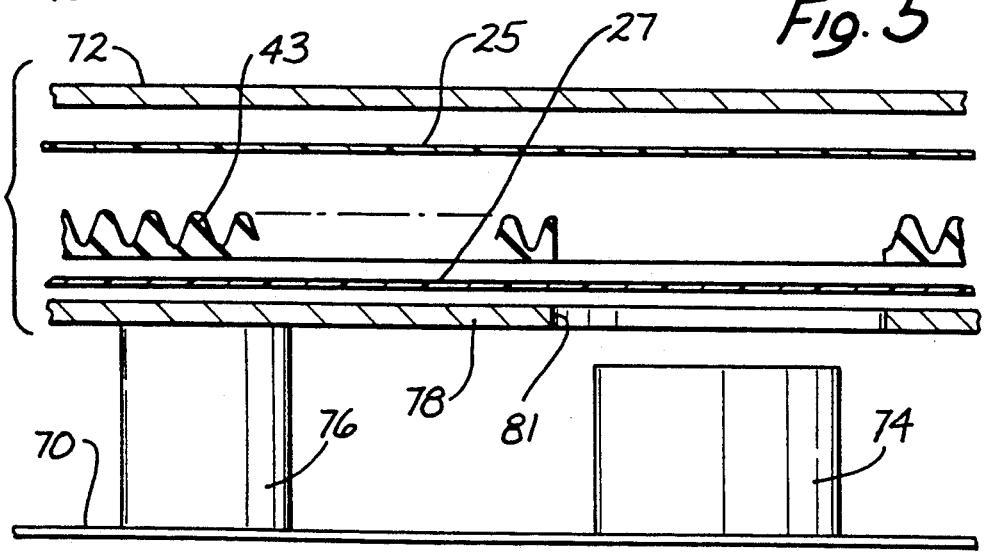
FIG. 5 is a side elevation view of a heat seal apparatus used in a preferred method of manufacturing the water mattress of the present invention.
Figure 7:
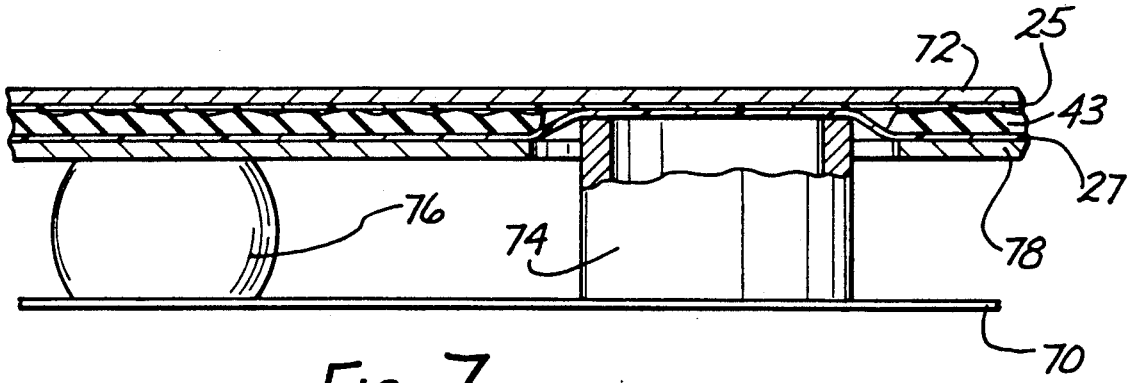
FIG. 7 is a side elevation view of the heat seal apparatus illustrating the heat seal conductor and the pillar in the compressed state.

This mattress 10 can be easily formed in accordance with a preferred method of the invention, the steps of which are illustrated in FIGS. 4 and 7. As illustrated in FIG. 5, a conventional radio frequency heat sealing apparatus can be provided with a pair of planar heat sealer dies 70 and 72. A conductor 74 typically formed from aluminum is placed on the die 70 and provided with the shape desired for the seals 52 and 67. One of the conductors 74 is provided for each of the seals 52 and 67. Each of the conductors 74 extends a first relatively short distance from the die 70 toward the die 72. One of the conductors 74 is provided for each of the seals 52 and 67.

A plurality of pillars 76 can also be disposed on the die 70. The pillars 76 are typically formed from a nonconductive material such as rubber, and preferably extend a second, relatively longer distance between the die 70 and the die 72. In a preferred method, one of the pillars 67 is provided between each of the adjacent conductors 74.

A planar support member 78 is disposed between the dies 70 and 72 and supported generally on the pillars 76. Portions of this support member 78 define holes which are generally concentric with, but larger than, the conductors 74. One of these holes 81 in the support 78 in overlying relationship with a respective conductor 74.

It is the purpose of the member 78 to provide a generally planar surface for supporting the foam sheet 43 sandwiched between the top sheet 25 and intermediate sheet 27. Each of the holes 50 in the foam sheet 43 is aligned with a respective hole 81 in the support 78 in overlying relationship with a respective conductor 74.

Figure 6:
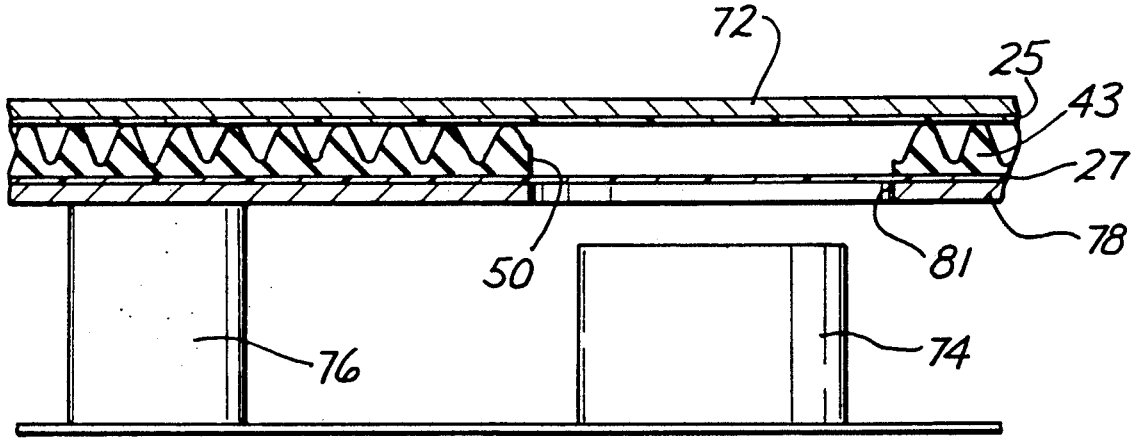
FIG. 6 is a side elevation view of the heat sealing apparatus illustrating a heat seal conductor and a pillar in its uncompressed state.

In accordance with a preferred method of manufacture, the upper die 72 is moved downwardly toward the die 70 into contact with the top sheet 25 as illustrated in FIG. 6. Further movement of the die 72 in the direction of the die 70 compresses the foam between the sheets 25 and 27 against the more rigid structure of the support member 78. This compression of the foam 43 continues with the downward movement of the die 72 until the force on the support member 78 begins to compress the pillars 76. Eventually, the pillars 76 compress to a vertical dimension which is less than the height of the conductor 74. At this point, radio frequency applied between the dies 70 and 72 is communicated through the conductor and forms the circular heat seals 52 and 67 between the sheets 25 and 27. The configuration of the manufacturing apparatus at the time of the heat sealing step is illustrated in FIG. 7.

At the same time the circular heat seals 52 and 67 are being formed, the sheets 25, 27 and the gusset panel 32 can be joined along the perimeter heat seal 34. It is this seal 34 which forms the air cavity 41 within which the foam sheet 43 is disposed.

When the upper die 72 is raised, there is no air in the cavity 41 so the foam sheet 43 remains compressed. Only when the vent holes 47 are cut, or an appropriate valve mechanism (not shown) is opened, can air enter the cavity 41 to permit the foam sheet 43 to expand. Even with the foam sheet 43 expanded, as illustrated in FIG. 8, the seals 52 maintain the foam 43 in the generally planar disposition in the cavity 41.

It will be apparent to those skilled in the art that the valve 61 must be positioned over its respective conductor 74 in order to form the heat seal 67. Then the central regions of the circular heat seal 67 can be cut or otherwise removed so that the valve 61 has access to the water cavity 38.

It is of particular advantage that the valve 61 provides access to the water cavity 38 but not the air cavity 41. Not only does the foam sheet 43 and the cavity 41 remain dry and therefore provide its optimum resiliency characteristics, but the water cavity 38 is much easier to empty. In the absence of any foam in the water cavity 38, there is no tendency for water to remain in the cavity 38.

Although the concept of this invention has been discussed with reference to specific embodiments, it will be apparent to those skilled in this art that the concept can be otherwise embodied. For example, the exact configuration of the mattress 10 as it applies to the vinyl sheets 23 and 27 and seals 30 and 34 which combine to form the water cavity 38, can vary significantly. Similarly, other means can be provided for joining the top sheet 25 to the bottom sheet 23 or the intermediate sheet 27. It may also be particularly advantageous that the top sheet 25 be formed from a vinyl material so that it can be heat sealed to one of the sheets 23 and 27, for example at the seal 34. Other means can be provided for maintaining the foam 43 in its preferred planar configuration. For example, the foam 43 can be tacked or otherwise glued to the intermediate sheet 27. Furthermore, the seals 52 can be eliminated in other areas of interest to provide increased support, for example at the head or feet of the user. It is due to these many possible variations, all within the totality of the concept, that the scope of the invention should be ascertained only with reference to the following claims.

I claim:

1. A water mattress, comprising:

a first sheet of heat sealable material forming a bottom of the mattress;

a second sheet of heat sealable material forming a top of the mattress;

a third sheet of heat sealable material disposed between the first sheet and the second sheet, the third sheet being sealed around its periphery to at least one of the first sheet and the second sheet;

the third sheet forming with the first sheet a bladder for receiving the water and forming with the second sheet a particular cavity isolated from the water in the bladder;

foam disposed in the particular cavity and having a state of optimum resiliency in air; and means for introducing air into the second cavity for maintaining the foam in the state of optimum resiliency.

2. A mattress having a top and a bottom and adapted to be at least partially fillable with water, comprising:

a first sheet of material defining the bottom of the mattress;

a second sheet of material defining the top of the mattress;

the first sheet and the second sheet forming a container for receiving the water;

a sheet of foam having a generally planar configuration, the foam being disposed in the container in proximity to the second sheet at the top of the mattress, and having optimum resiliency characteristics which degrade in contact with water, portions of the foam sheet defining a plurality of holes;

a third sheet of material disposed in the container between the first sheet and the second sheet for isolating the sheet of foam from the water in the container, the third sheet dividing the container into a bladder for receiving the water and a cavity for receiving the foam;

means for maintaining the foam in its generally planar configuration in the container; and means for joining the second sheet and the third sheet through the holes in the foam sheet for maintaining the foam sheet in its generally planar configuration within the container.

3. The mattress recited in claim 2 wherein the third sheet has a perimeter edge and the mattress further comprises, means forming a seal between the perimeter edge of the third sheet and at least one of the first sheet and the second sheet, for sealing the cavity from the bladder.

4. The mattress recited in claim 2 wherein the cavity includes fibers.

5. The mattress recited in claim 4 wherein the fibers are formed of a polyester material.

6. A mattress having a top and a bottom and adapted to be at least partially fillable with water, comprising:

a first sheet of material defining the bottom of the mattress;

a second sheet of material defining the top of the mattress;

the first sheet and the second sheet forming a container for receiving the water;

a sheet of foam having a generally planar configuration, the foam being disposed in the container in proximity to the second sheet at the top of the mattress, portions of the foam sheet defining a plurality of holes;

a third sheet of material disposed in the container dividing the container into a bladder for receiving the water and a cavity for receiving the foam;

means for maintaining the foam in its generally planar configuration in the container; and means for joining the second sheet and the third sheet through the holes in the foam sheet for maintaining the foam sheet in its generally planar configuration within the container.

7. A water mattress, comprising:

a first sheet of heat sealable material forming a bottom of the mattress;

a second sheet of heat sealable material forming a top of the mattress;

a third sheet of heat sealable material disposed between the first sheet and the second sheet, the third sheet being sealed around its periphery to at least one of the first sheet and the second sheet;

the third sheet forming with the first sheet a bladder for receiving the water and forming with the second sheet a particular cavity;

foam disposed in the particular cavity and including portions which define a plurality of holes; and means for joining the second sheet to the third sheet through the holes in the foam for maintaining the foam in a generally planar configuration.

* * * * *